US011059656B1

(12) United States Patent
Rodriguez et al.

(10) Patent No.: US 11,059,656 B1
(45) Date of Patent: Jul. 13, 2021

(54) SINGLE-USE BOX PAPER TURN-UP SYSTEM

(71) Applicant: Sandar Industries, Inc., Atlantic Beach, FL (US)

(72) Inventors: Victor Rodriguez, Jacksonville, FL (US); Peter A. Rodriguez, Jacksonville, FL (US)

(73) Assignee: Sandar Industries, Inc., Atlantic Beach, FL (US)

( * ) Notice: Subject to any disclaimer, the term of this patent is extended or adjusted under 35 U.S.C. 154(b) by 2 days.

(21) Appl. No.: 16/849,351

(22) Filed: Apr. 15, 2020

Related U.S. Application Data

(60) Provisional application No. 62/972,969, filed on Feb. 11, 2020.

(51) Int. Cl.

| | |
|---|---|
| ***B65D 83/00*** | (2006.01) |
| ***B65H 16/00*** | (2006.01) |
| ***B65H 18/00*** | (2006.01) |
| ***B65D 83/08*** | (2006.01) |
| ***B65H 18/28*** | (2006.01) |

(52) U.S. Cl.
CPC ..... *B65D 83/0805* (2013.01); *B65H 16/00* (2013.01); *B65H 18/28* (2013.01)

(58) Field of Classification Search
CPC ..... B65H 16/00; B65H 18/00; B65H 18/20; B65H 18/28; B65D 83/00; B65D 83/08; B65D 83/0805
See application file for complete search history.

(56) References Cited

U.S. PATENT DOCUMENTS

| | | | | |
|---|---|---|---|---|
| 6,578,788 | B2 * | 6/2003 | Rodriguez | B65H 19/26 242/526.2 |
| 7,875,152 | B2 * | 1/2011 | Rodriguez | D21F 7/04 162/263 |
| 8,124,209 | B2 * | 2/2012 | Rodriguez | B65H 19/283 428/40.1 |

* cited by examiner

*Primary Examiner* — Jacob T Minskey
*Assistant Examiner* — Matthew Hoover
(74) *Attorney, Agent, or Firm* — Rogers Towers, P.A.; Joseph P. Kincart

(57) ABSTRACT

A single-use box containing a paper band coil. Previously known methods of feeding a paper band coil into turn-up machines are spatially inefficient and may cause significant problems in application. In contrast, this pre-loaded, single-use box is an adaptable and efficient way to feed paper band coil into a variety of turn-up machine configurations.

9 Claims, 9 Drawing Sheets

SINGLE-USE BOX PAPER TURN-UP SYSTEM

CROSS-REFERENCE TO RELATED APPLICATIONS

This application claims the benefit of U.S. Provisional Application No. 62/972,969, filed Feb. 11, 2020, the contents of which are incorporated herein by reference in their entirety.

FIELD OF THE DISCLOSURE

This invention relates generally to the field of transfer tapes and methods of using transfer tapes to effect the high-speed severing and transfer of a rapidly advancing paper web from a rotating full spool onto an empty spool. More particularly, the present invention relates to a single-use box of turn-up paper band to improve paper turn-up system installation and turn-up system efficiency.

BACKGROUND OF THE DISCLOSURE

Modern paper manufacturing is typically performed by producing continuous lengths of paper having widths of over 400 inches, in some cases referred to as paper webs, which are wound onto spools to form rolls for subsequent converting, storage, transfer, or the like. The winding or spooling operation for the paper web occurs at high speeds, in some cases exceeding 6000 feet per minute. In order to maximize production by minimizing downtime and waste, it is desirable to sever and simultaneously transfer the moving paper web from a full spool onto an empty spool without stopping or slowing the movement of the web, or without adjusting draws (i.e. the speed differential between the incoming and outgoing web rotating support members that are not driven by a common source). Methods and apparatus for this severing and transfer using what is known as a transfer or turn-up tape have long been known. An early example of such an apparatus is shown in U.S. Pat. No. 2,461,246 to Weyenberg, issued in 1949. Other examples are shown in my U.S. Pat. Nos. 4,659,029, 4,757,950, 4,783,018, 5,046,675, 5,453,141, 5,637,170, and 5,954,290. Further examples and detailed discussion of such equipment, systems and methodologies are presented in our U.S. Pat. Nos. 4,659,029, 4,757,950, 4,783,018, 5,046,675, 5,417,383, 5,453,141, 5,637,170, 5,954,290, 6,467,719, 6,578,788, 7,875,152, 8,124,209, 8,178,181 and 8,580,062.

Manufactures of transfer tape-based turn-up systems utilize coils of paper band as transfer tapes. Typically, a coil contains as much as 3000 feet of paper band, which is generally sufficient for use over a number of days without needing to reload the supply of paper band. However, a high capacity paper band roll can diminish the adaptability of the turn-up equipment. The high capacity paper band supply roll can take up a significant amount of space in an already-cramped area adjacent to the reel section of a paper machine (where the coil is ideally positioned for use). This additional space requirement can result in the supply roll having to be placed some distance away from the turn-up equipment. Placement away from the turn-up system may also create problems because it requires two points of access to operate the turn-up system (instead of one) and leads to suboptimal routing from the coil to the equipment. While field-fabricated tubes and guides, along with free-routing the paper turn-up band around existing equipment, have been used in crowded installations, these workarounds may be unreliable, unsafe, and prone to introduce deleterious debris into the turn-up mechanisms.

SUMMARY OF THE DISCLOSURE

Accordingly, the present invention provides for a single-use box or carton that is preloaded with a length of paper band suitable for one cycle of the turn-up equipment. The single-use box contains a pre-measured length of paper band that can interrupt the path of finished paper between the drum and full spool to bind the paper to an empty spool without stopping any portion of the papermaking process. Such a single-use box may optimize equipment placement, reliability, and convenience of use (particularly for loading and operating turn-up systems). For example, the single-use box may make a turn-up machine more efficient by reducing the number of missed turn-ups caused by interruption in the conduction of turn-up tape from the supply coil to the dispenser, or from damage to and related weakening of the turn-up tape.

Moreover, in some embodiments of the invention, an adhesive may be pre-applied to the paper band in the single-use box, which may be desirable in systems that lack an integrated applicator for adhesives. In such systems, an operator typically applies a suitable length of adhesive to one side of the leading end of the paper band, and then inserts that end into an inlet of the turn-up system's mechanism. Manual application of adhesive can have several variables and inconsistency factors that may become troublesome because the turn-up procedure depends on the accurate and secure placement of the adhesive. However, for a single-use box as described herein, pre-application may be performed by a repeatable, precise method at the supplier's facility, which may increase reliability and may also significantly improve the convenience of using a turn-up system. Moreover, this system may reduce the recovery time for a turn-up system after the exhaustion of a paper band coil, thus reducing waste in the papermaking operation.

Additionally, the inventions discussed herein assist operators of rudimentary turn-up systems (or backup turn-up systems) that do not have the means to form a coil of paper band. Such operators typically prepare the paper band for each cycle by hand. This requires measuring the required length, cutting it, and rolling up a ribbon-wound coil without exceeding the physical dimensions of a reservoir associated with the turn-up machine. After all of those steps, the operator must still maneuver the coil into the turn-up mechanism. This may be inefficient and frustrating. The present single-use box of the invention may solve this problem.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure.

DETAILED DESCRIPTION

Figure 1:
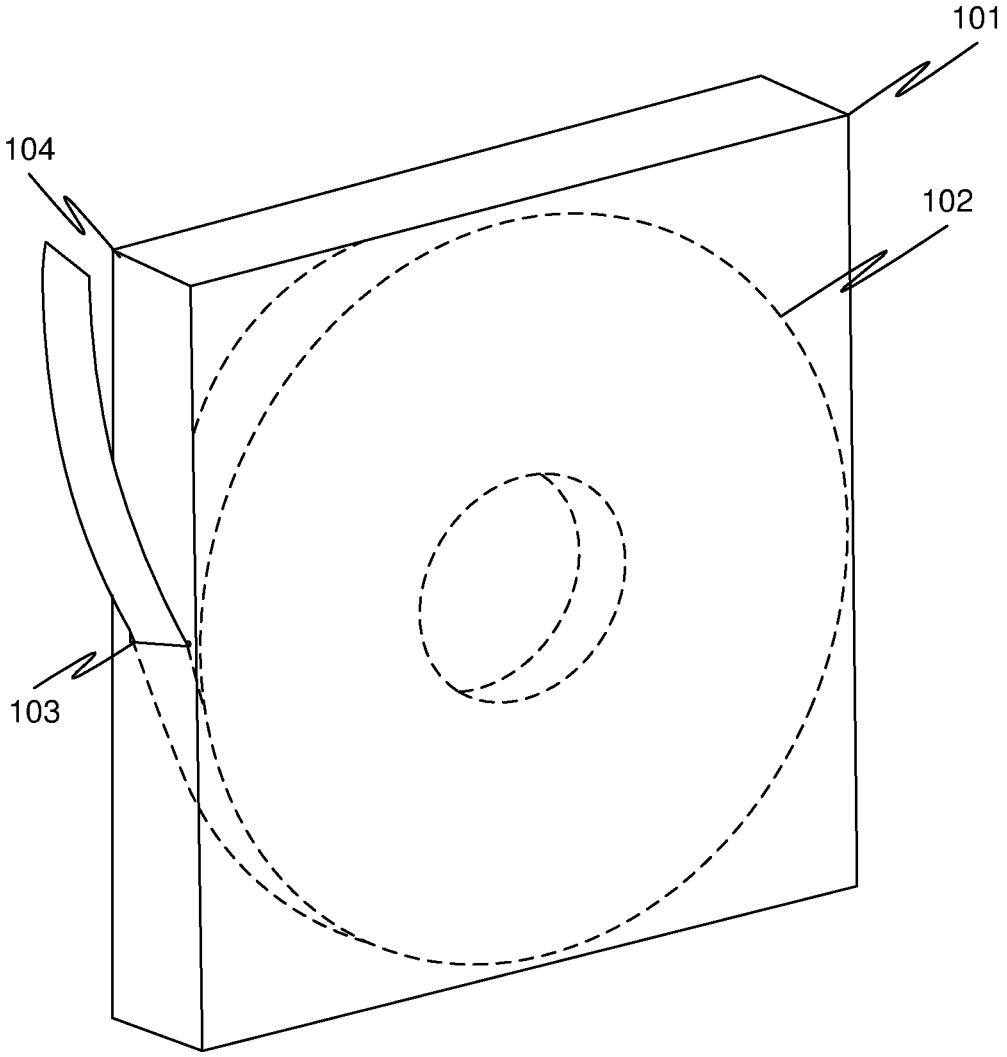
FIG. 1 illustrates a single-use transfer tape dispenser box according to an embodiment of the invention.

As used in the description of the invention and the appended claims, the singular forms "a," "an" and "the" are intended to include the plural forms as well, unless the context clearly indicates otherwise.

A number of embodiments of the present disclosure have been described. While this specification contains many specific implementation details, they should not be construed as limitations on the scope of any disclosures or of what may be claimed, but rather as descriptions of features specific to particular embodiments of the present disclosure. While embodiments of the present disclosure are described herein by way of example using several illustrative drawings, those skilled in the art will recognize the present disclosure is not limited to the embodiments or drawings described. It should be understood the drawings and the detailed description thereto are not intended to limit the present disclosure to the form disclosed, but to the contrary, the present disclosure is to cover all modification, equivalents and alternatives falling within the spirit and scope of embodiments of the present disclosure as defined by the appended claims.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while method steps may be depicted in the drawings in a particular order, this should not be understood as requiring that such operations be performed in the particular order shown or in a sequential order, or that all illustrated operations be performed, to achieve desirable results.

Provided according to embodiments of the invention are single-use transfer tape dispensing boxes. Such boxes include a length of paper band sufficient to perform one turn-up cycle in a paper-web turn-up procedure. In some embodiments of the invention, the box includes a hollow cavity; a coil of paper band housed within the hollow cavity, the paper band including a first face and a second face and a predetermined length suitable for a single turn-up procedure for slicing a paper roll on a paper machine, the paper band further including a proximal end and a distal end; and a slot on the box through which an proximal end of the coil of paper band may be fed to allow the end to pass outside the box.

The term "box," as used herein, encompasses any means of providing a hollow cavity for the coil of paper band, including a carton, cartridge, bag, case, container, and the like. Additionally, the term "hollow cavity" refers to the space in the box for the coil of paper band, but does not preclude the presence of other minor elements including, but not limited to, a hub on which the paper band may be coiled, support structures to maintain the position of the paper band coil in the box, lubricant, an adhesive applicator, and instructions or other documentation. Furthermore, when the paper band is said to be fed through a "slot," this term is meant to encompass any element of egress from the box, including a hole, slit, spout, exit, outlet, and the like.

As used herein, "turn-up tape," "transfer tape," "paper band," and "paper tape" may be used interchangeably. These terms refer to the paper band used in a paper web turn up operation for severing and transferring a continuous paper (or other paper product) web onto an empty spool. Any suitable transfer tape may be used in the single-use boxes described herein, and such transfer tapes may be made from any suitable materials (e.g., repulpable paper tape) and in any designs, including those having multiple layers, flaps, liners, single or multiple fiber reinforcement channels, and the like. The length of transfer tape needed for a single-use will depend on the particular parameters of the turn-up machine, paper web machine, and the paper web. However, such single-use dispensing boxes may be manufactured at a few, some, or several different pre-measured lengths. The paper band length used by a particular paper machine/turn-up system is typically at least the length needed to perform one turn-up cycle but less than needed for two turn-up cycles. For example, if a particular paper web turn-up system requires 75 feet of paper band to perform one turn up cycle, the operator could install a single-use turn-up dispenser box that has at least 75 feet of transfer tape. For example, the operator could use a 100 feet single-use transfer tape dispensing box, and any excess paper tape (~25 feet) will not be used.

In some embodiments of the invention, an adhesive is fixedly attached to the paper band and located at the proximal end of the paper band. Furthermore, in some embodiments, an adhesive liner is removably attached to the adhesive during storage in the single-use box and may be removed by an operator (or a mechanical or automated device) before performing a turn-up procedure. Typically, a pre-applied adhesive is only present on a first 6 to 12, 18, 24, or 36 inches of the proximal end of the paper tape coil, but any amount of pre-applied adhesive suitable for performing a paper web turn-up procedure may be present.

The single-use paper tape dispensing boxes may be used in or with any suitable transfer tape dispensing apparatus, provided that there is a securing means, including but not limited to those described herein, to secure the box against excessive movement during a turn-up procedure. In some embodiments, such apparatus may not include a cutting means since the paper tape does not need to be cut prior to use in the apparatus. The single-use tape dispensing boxes may be used to sever a web of paper in any paper web turn-up procedure known to those of skill in the art, including, but not limited to, those described herein.

In FIG. 1, an embodiment of a single-use tape dispensing box is shown. A single-use box 101 is proportioned to enclose paper band coil 102 in a hollow cavity within single-use box 101. In particular embodiments, paper band coil 102 is a flat, ribbon-wound coil. Moreover, in some embodiments, the base length of single-use box 101 (i.e., the distance between its sidewalls) is slightly longer (e.g., less than 2%, 5% or 10% longer) than the width of the paper band coil 102 to prevent the paper band coil 102 from telescoping or tangling in transit, storage, and use.

Single-use box 101 may include slot 103 through which the paper band coming off paper band coil 102 may exit. This may allow access to the paper band without opening single-use box 101. The slot 103 may be at any suitable position on the sidewall including the top, bottom, or substantially at the midpoint of the sidewall as shown. In some embodiments, single-use box 101 may further include a door or some other mechanism to allow for retrieval of an end of paper band coil 102 in case an end is no longer accessible outside slot 103. This end of paper band coil 102 may be secured against snagging or unintentional pulling out from the box by tucking it into box edge 104 or other similar means. The end may also be secured to the outside of the box by an adhesive, pin, band, or other securing means.

The hollow cavity in single-use box 101 may take any desirable shape. For example, in some embodiments, the hollow cavity may be a quadrilateral of sufficient size to inscribe paper band coil 102 within it. The hollow cavity may have space around its corners that is unoccupied by paper band coil 102 to allow pins, nails, or other securing means to pass through the hollow cavity. The hollow cavity may include a lubricant, an adhesive applicator, or other useful apparatus. In some embodiments, single-use box 101 may include a means of ingress into the hollow cavity for quality control purposes with respect to issues that may arise with the dispensing of paper band coil 102.

Figure 2A:
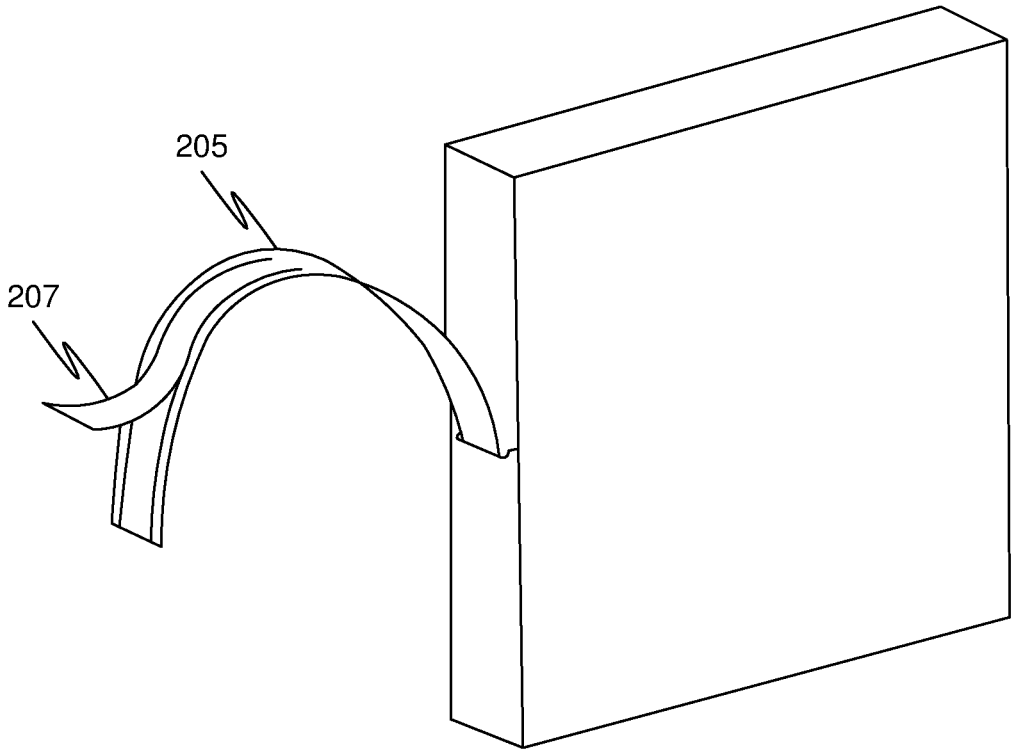
FIGS. 2A and 2B illustrate that adhesive may be applied to either side of the transfer tape in a single-use tape dispenser box according to an embodiment of the invention.
Figure 2B:
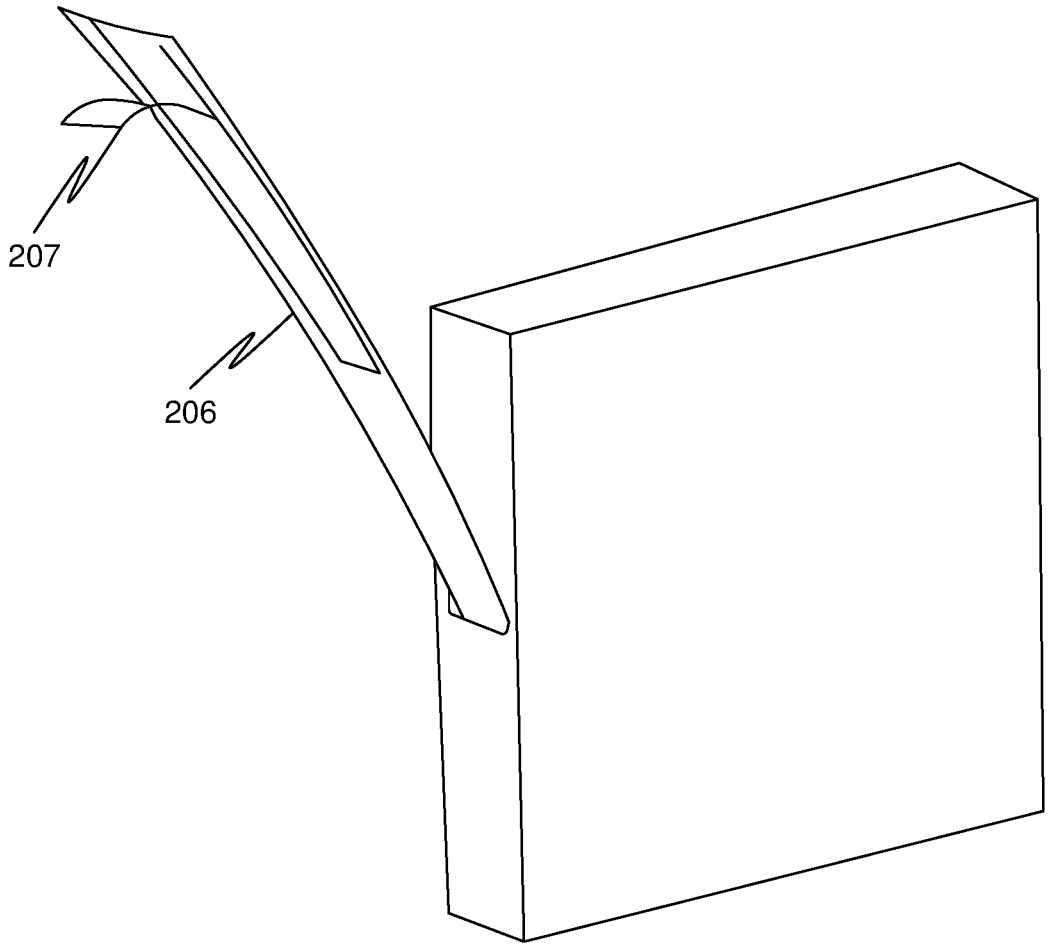

Referring now to FIGS. 2A and 2B, particular adhesive application methodologies are shown. The method of applying adhesive may vary depending on the configuration of the tape dispensing apparatus used. Adhesive may be applied to the exposed inner face 205 or outer face 206 of the paper band. The face on which the adhesive may be applied may be based on the configuration of a particular module. In some embodiments, no adhesive liner 207 is used. Furthermore, in some embodiments, the adhesive discussed in connection with FIGS. 2A and 2B need not be pre-applied—it can be applied by an operator on site. In other embodiments, adhesive liner 207 may be removably attached from the proximal end of the paper band to allow for easier shipping of paper band coil. Once removed on site, the adhesive liner 207 may leave behind an appropriate amount of adhesive on the paper band.

Figure 3:
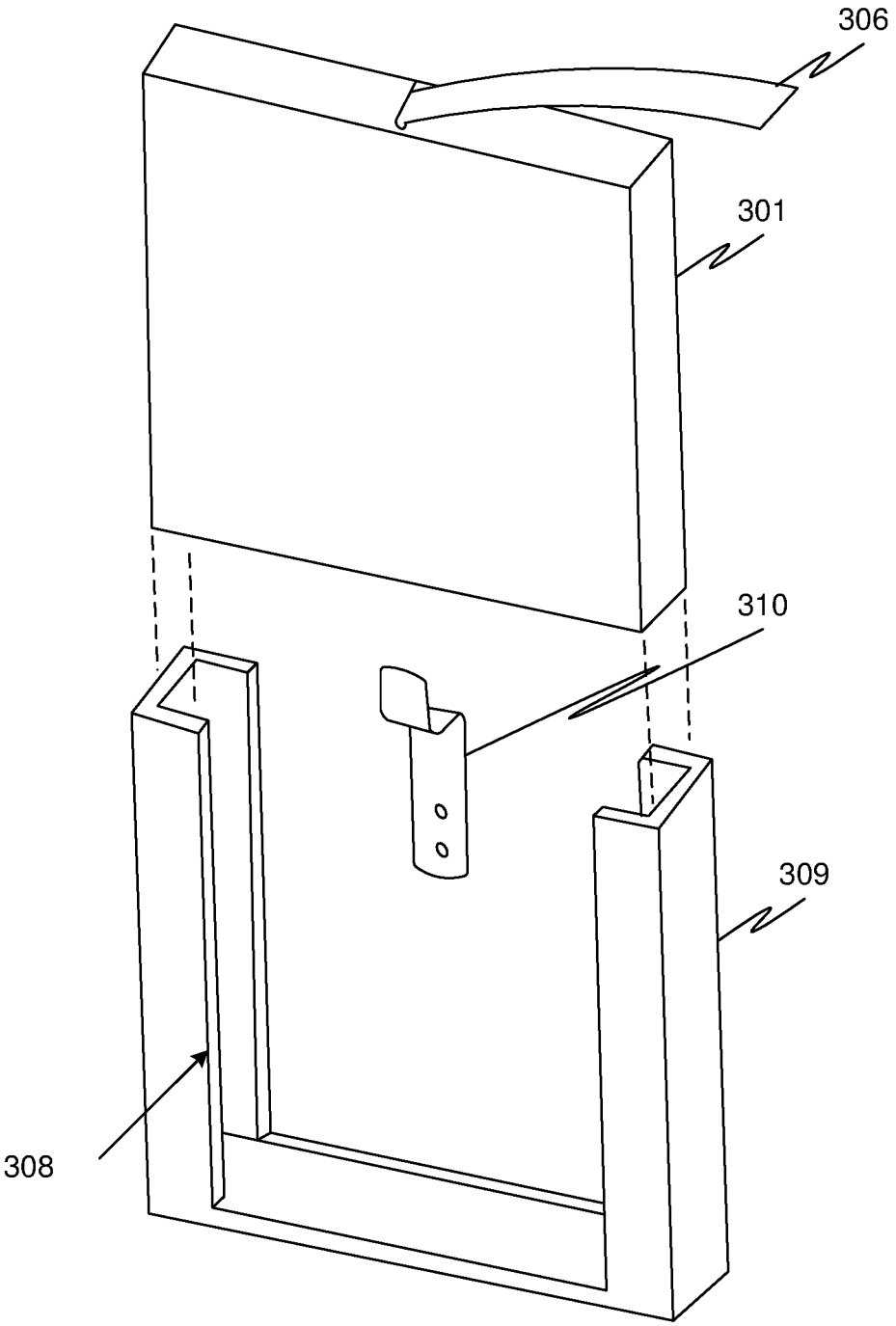
FIG. 3 illustrates an example of a single-use tape dispenser box holder configuration.

Referring now to FIG. 3, an embodiment of the single-use box 301 in use with a holder 309 is shown. The holder 309 may be proximate to, or present within, a paper web tape dispensing system. Doing so allows an operator to free the exposed end 306 of the paper band. After freeing exposed end 306, the operator may remove the liner (not shown) from the adhesive strip and insert exposed end 306 into a nip cylinder/drive mechanism of a tape dispensing module. In some embodiments, holder 309 may be fixedly or removably attached to a reservoir of a tape dispensing module by a securing means including, but not limited to, screws, protrusions, hinges, clips, magnets, adhesive, and the like.

In some embodiments, holder 309 may comprise one or more channels 308 in which the narrow edges of single-use box 301 may slide. In some embodiments, holder 309 may further comprise clips 310 to secure single-use box 301 in holder 309 by, for example, a clip across the opening of the receiver. In some embodiments, channels 308 may comprise magnetic strips or other similar temporary-adhesion means to secure single-use box 301 in holder 309 temporarily. In some embodiments, channels 308 may include additional sealing mechanisms, such as slidable stops to prevent single-use box 301 from moving in holder 309 after being placed in holder 309.

Figure 4:
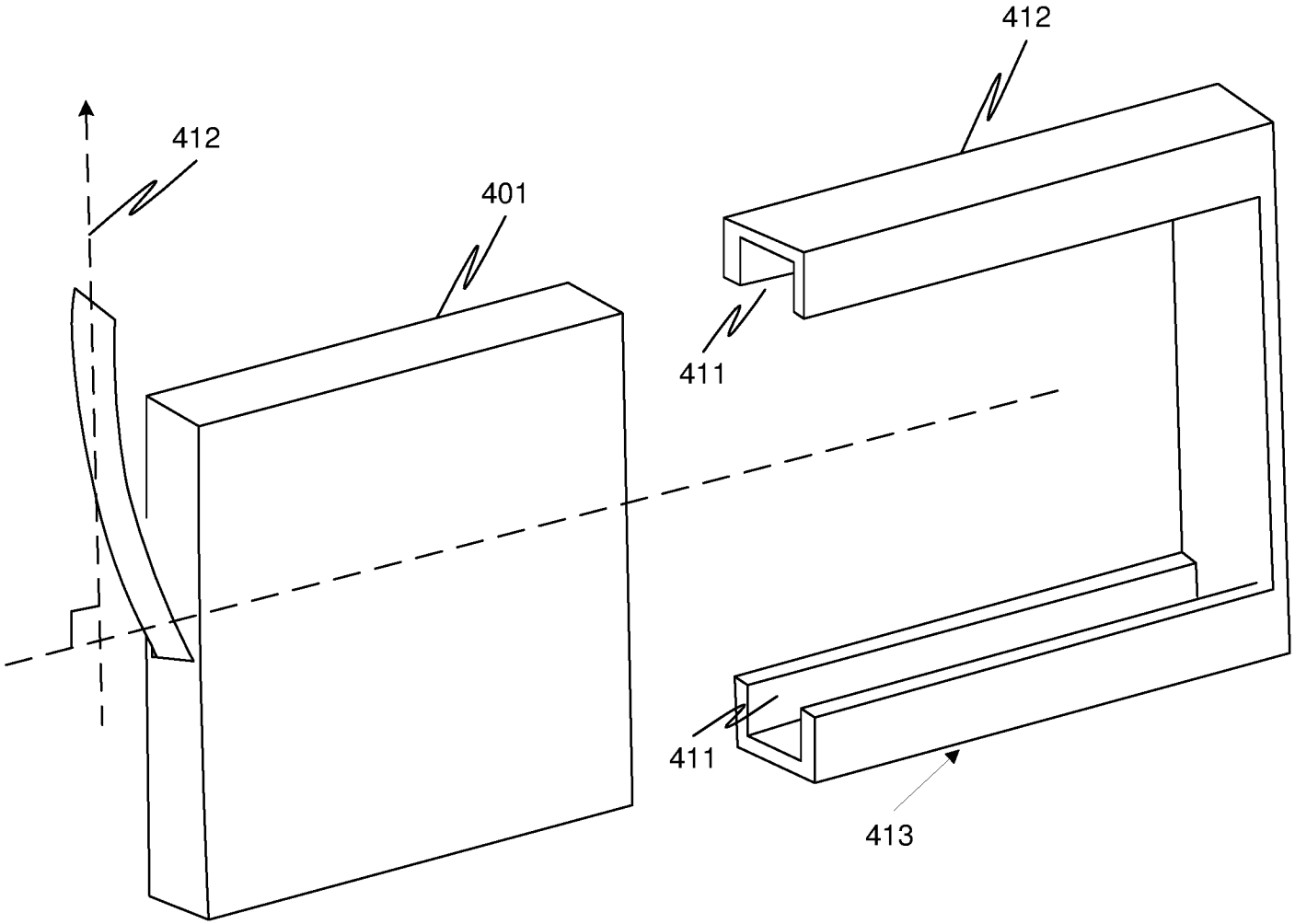
FIG. 4 illustrates another example of a single-use tape dispenser box holder configuration.

Another configuration of a holder is illustrated in FIG. 4. Channels 411 may be oriented in the reservoir perpendicularly to the principle direction of motion 412 of the paper band. In this way, as the turn-up machine exerts a force on single-use box 401 in the principle direction of motion 412, holder 413 may resist such motion. In some embodiments, an additional securing means, as described above, may be used to further attach the holder to the tape dispensing apparatus to assist in resisting spurious forces parallel to the principle direction of motion 412 of the paper band.

Figure 5:
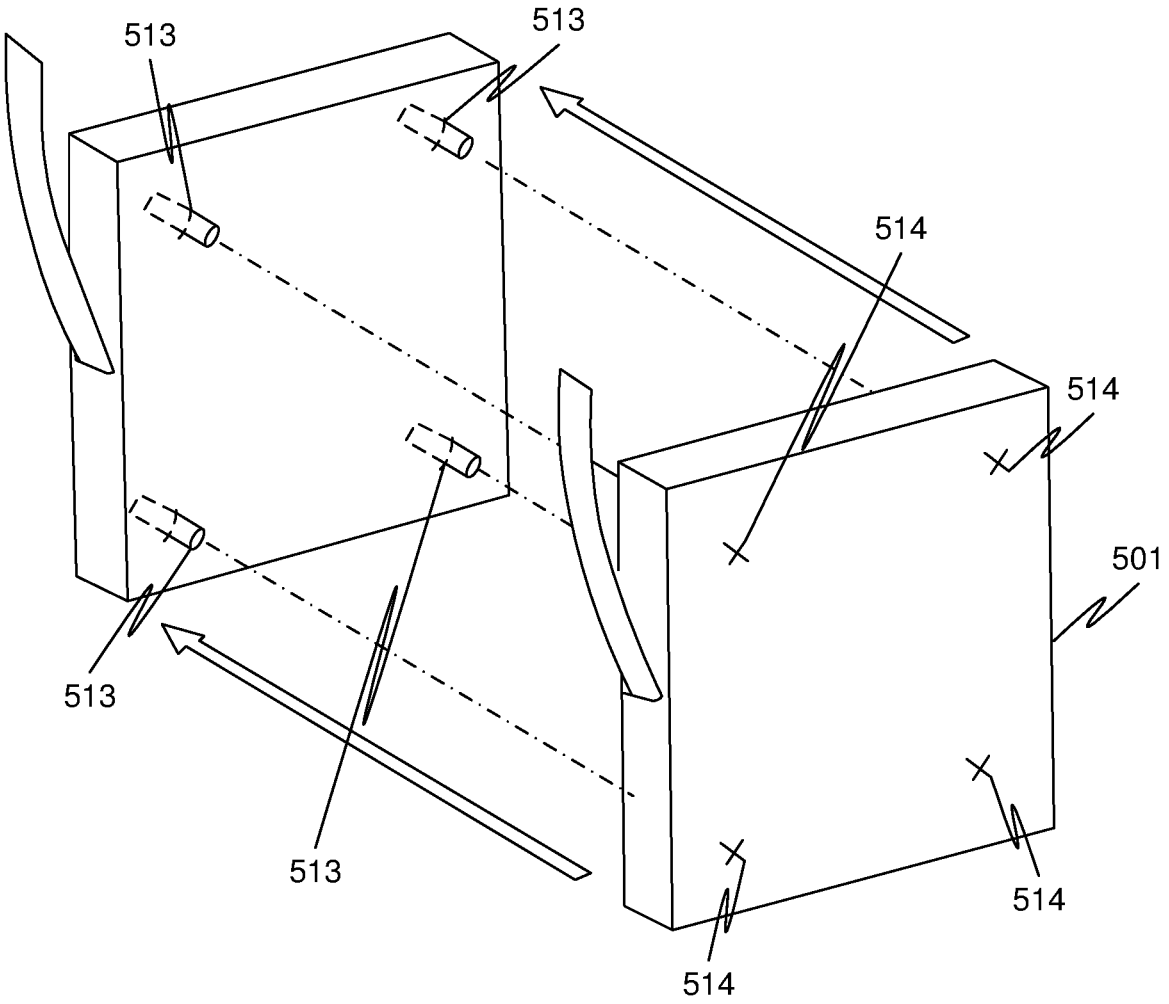
FIG. 5 illustrates another example of a single-use tape dispenser box holder configuration.

Another tape dispensing box securing mechanism is illustrated in FIG. 5. Single-use box 501 may be impaled on two or more pins 513 in the reservoir that may be aligned with piercings 514 in the front and back faces of single-use box 501, such that the pins hold single-use box 501 securely and enforce the correct orientation when seating the box in the turn-up mechanism by virtue of an asymmetrical arrangement of the pins, or by markings on the box itself. In some embodiments, pins 513 may be fixedly attached to a portion of the turn-up mechanism, and single-use box 501 may be impaled thereupon. In other embodiments, pins 513 may be fixedly or pierced attached to single-use box 501 and may interconnect with receiving portions on the turn-up mechanism or the holder.

Figure 6:
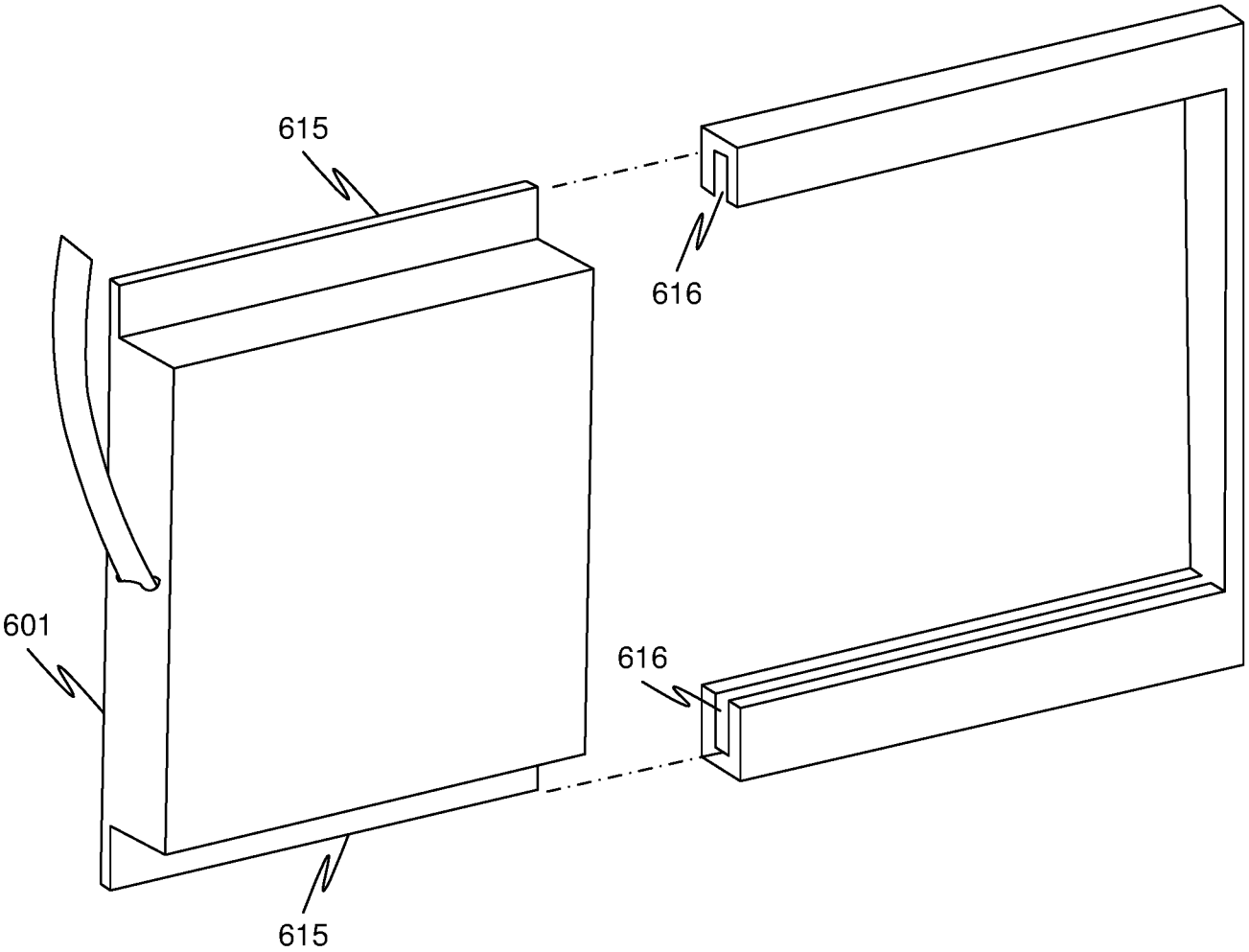
FIG. 6 illustrates another example of a single-use tape dispenser box holder configuration.

Another tape dispensing box holder configuration is illustrated in FIG. 6. In this embodiment, wings 615 may extend from at least two sides of single-use box 601 to engage narrow channels 616. Depending on the configuration of the turn-up mechanism, qualities of the paper, and the like, this embodiment may be preferable to the channel embodiment shown in FIG. 3. In some embodiments, the width of wings 615 may be adjustable by, for example, sliders. This may allow the same single-use box 601 to fit a variety of holders. In some embodiments, wings 615 may have securing means (e.g., a clip, a slot, an adhesive) to which the proximal end of the paper band coil may be temporarily attached to prevent the paper band coil from telescoping or tangling during transit.

The single use tape dispensing boxes may be used with any suitable known or later invented transfer tape dispensing apparatus and methods. In embodiments wherein the proximal end of the paper band has adhesive pre-applied, methods of using a single-use tape dispensing box generally include releasing a proximal end of a coil of paper band in the box for use, such as by threading the proximal end through a slot in the sidewall of the box, or by releasing the proximal end of the paper band from a position secured outside the box; removing an adhesive liner from an adhesive on the proximal end of the paper band; and inserting the proximal end of the paper band into a track inlet of the transfer tape dispensing apparatus. Some methods further include placing the single-use dispensing box proximate to a transfer tape dispensing apparatus, such as in a holder in a reservoir of the tape dispensing apparatus. This may be performed before or after the proximal end of the coil of paper band is released from the box. After the paper tape has been inserted into the track inlet of a paper dispensing apparatus, any of the paper web turn up methods described herein may be used.

Figure 7:
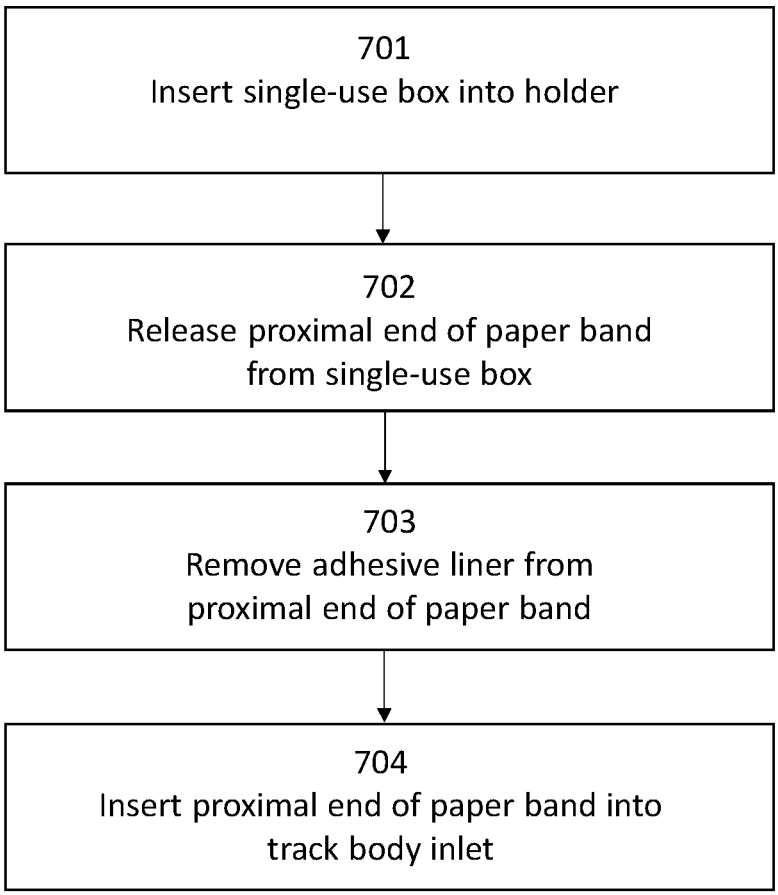
FIG. 7 provides a flow chart for method steps related to certain aspects of the invention.

Referring to FIG. 7, some embodiments of the invention include: inserting a single-use tape dispensing box into a holder (701), such as a holder in a reservoir of a tape-dispensing apparatus; releasing a proximal end of the paper band from the single-use box (702); removing an adhesive liner from the proximate end of the paper band (703); and inserting the proximal end of paper band into a track body inlet of a tape dispensing apparatus (704). As noted above, in some embodiments, step 701 may be performed after step 702, or even after step 703. After insertion of the paper band into the tape dispensing apparatus, the turn-up tape may be loaded into the cross-machine track and then used to perform one turn-up cycle, whereby the transfer tape effects the sever and transfer of a paper web from a rotating full spool onto an empty spool.

In some embodiments of the invention, the paper band does not have pre-applied adhesive. As such, in these embodiments, methods of using a single-use tape dispensing box generally include releasing a proximal end of a coil of paper band in the box for use, such as by threading the proximal end through a slot in the sidewall of the box, or by releasing the proximal end of the paper band from a position secured outside the box; applying an adhesive to the proximal end of the paper band; and inserting the proximal end of the paper band into a track inlet of a transfer tape dispensing apparatus. Some methods further include placing the single-use dispensing box proximate to a transfer tape dispensing apparatus, such as in a reservoir of the tape dispensing apparatus. This may be performed before or after the proximal end of the coil of paper band is released from the box. After the paper tape has been inserted into the track inlet, any of the paper web turn up methods described herein may be used.

Figure 8:
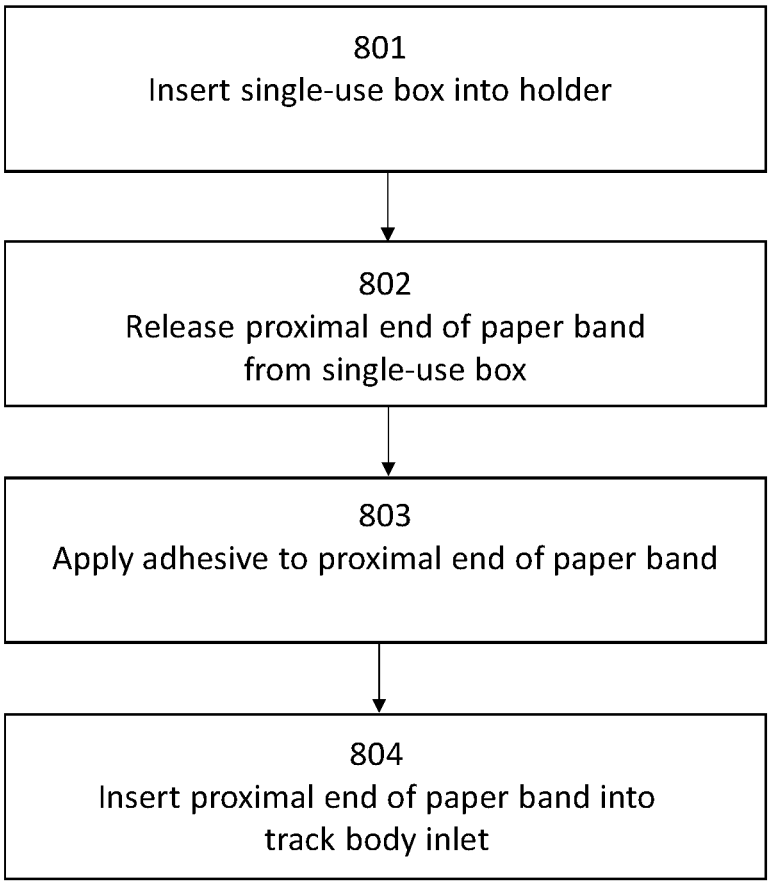
FIG. 8 provides a flow chart for method steps related to certain aspects of the invention.

Referring to FIG. 8, some embodiments of the invention include: inserting a single-use tape dispensing box according to the invention into a holder (801), such as a holder in a reservoir of a tape-dispensing apparatus; releasing a proximal end of the paper band from the single-use box (802); applying an adhesive to the proximate end of the paper band (803); and inserting the proximal end of paper band into a track body inlet of a tape dispensing apparatus (804). As noted above, in some embodiments, step 801 may be performed after step 802, or even after step 803. After insertion of the paper band into the tape dispensing apparatus, the turn-up tape may be loaded into the cross-machine track and then used to perform one turn-up cycle, whereby the transfer tape effects the sever and transfer of a paper web from a rotating full spool onto an empty spool.

In the methods described herein, any of the single-use transfer tape dispensing boxes of the invention may be used. Furthermore, the position proximate to the transfer tape dispensing apparatus may be within the apparatus (e.g., in a reservoir), and may be secured by any means, including a holder or other means described herein.

What is claimed is:

1. A method of deploying a single-use box for use in a transfer tape dispensing apparatus, the method comprising the steps of:

(a) releasing a proximal end of a paper band arranged in a coil in the single-use box, wherein the single-use box comprises a box comprising a hollow cavity;

the paper band housed within the hollow cavity, the paper band comprising a first face and a second face and a predetermined length suitable for a single turn-up procedure for slicing a paper roll on a paper machine, the paper band further comprising the proximal end and a distal end;

(b) exiting the proximal end of the paper band through a slot in the box; and (c) feeding the proximal end of the paper band into the transfer tape dispensing apparatus.

2. The method of claim 1, wherein the paper band comprises an adhesive fixedly attached to the proximate end of the paper band.

3. The method of claim 2, wherein the proximal end of the paper band further comprises an adhesive liner releasably attached to the adhesive, and wherein the method further comprises removing the adhesive liner from the proximal end of the paper band prior to feeding into the transfer tape dispensing apparatus.

4. The method of claim 1, further comprising the step of placing the single-use box in a box holder.

5. The method of claim 4, wherein the box holder comprises a channel having a width greater than the width of a channel side of the single-use box.

6. The method of claim 4, further comprising the step of securing the single-use box to the box holder with a clip.

7. The method of claim 4, further comprising the step of securing the single-use box to the box holder with pins.

8. The method of claim 4, wherein the box holder comprises a channel having a width smaller than the width of a channel side of the box, and the channel side of the box comprises a wing having a wing width smaller than the width of the channel.

9. The method of claim 4, further comprising the step of attaching the box holder to the transfer tape dispensing apparatus.

* * * * *